US005603664A

United States Patent [19]

Provost

[11] Patent Number: 5,603,664

[45] Date of Patent: Feb. 18, 1997

[54] AUTOMATIC GOLF BALL TEEING UP APPARATUS

[75] Inventor: Serge Provost, 135, rue Principale, St-Benoît, Lâbre, Beauce-Sud, Province of Quebec, Canada, G0M 1P0

[73] Assignees: Serge Provost; Martin Binet, both of St-Benoît, Canada

[21] Appl. No.: 628,034

[22] Filed: Nov. 24, 1995

[51] Int. Cl.[6] ..... A63B 57/00

[52] U.S. Cl. ..... 473/134; 473/136; 473/168

[58] Field of Search ..... 473/132–137, 473/150, 157, 158, 167, 168, 169, 171, 278, 405, 407, 409; 273/87 R, 87 G, 138 R, 141 R

[56] References Cited

U.S. PATENT DOCUMENTS

| | | | |
|---|---|---|---|
| 3,294,402 | 12/1966 | Scott | 473/136 |
| 3,778,067 | 12/1973 | Gentiluomo | 473/136 |
| 3,990,708 | 11/1976 | Ingwersen | 473/168 |
| 4,113,260 | 9/1978 | Sain | 273/141 R |
| 4,189,152 | 2/1980 | Raber | 473/168 |
| 5,282,629 | 2/1994 | Eckstein | 473/135 |
| 5,348,305 | 9/1994 | Lowe | 473/135 |
| 5,439,224 | 8/1995 | Bertoncino | 473/168 |

*Primary Examiner*—Steven B. Wong
*Attorney, Agent, or Firm*—Robic

[57] ABSTRACT

Disclosed is an apparatus for automatically teeing up golf balls having a hopper, a teeing up device and a control panel. The hopper is operatively connected to the teeing up device to supply golf balls to the automatic teeing up device. The teeing up device comprises a piston moving between a lowermost and an uppermost position within a guide cylinder below the ground level. Golf balls are selected and allowed on a tee one at the time. The tee is adjustable in height to simulate a tee off lie or a fairway lie. A detector is located under the tee to detect the presence of a golf ball on the tee to automatically tee up another golf ball when needed. The control panel activates, controls or deactivates the automatic teeing up device. Also disclosed is a kit for practicing golf having targets posted in a driving range at different distances from the tee off, a device comprising an arrow spun on a board around choices of target for randomly choosing one of these targets and an apparatus for automatically teeing up the golf balls. The kit and the apparatus are intended both for indoor and outdoor use in a driving range or a simulated golf course. Furthermore, the kit is intended to allow a golfer to practice precise golf shots in terms of distance and direction.

18 Claims, 8 Drawing Sheets

AUTOMATIC GOLF BALL TEEING UP APPARATUS

FIELD OF THE INVENTION

The present invention relates to an apparatus for automatically teeing up golf balls. The invention also relates to a kit for practicing golf, in order to improve the precision and the distance of a golfer's shot aiming at a specific target.

DESCRIPTION OF THE PRIOR ART

In the last few years, the number of persons practicing golf has increased, especially with the opening of interior simulated golf clubs and interior driving ranges. Presently, a golfer in a driving range has to position manually golf balls on a tee. To avoid such cumbersome operation, teeing up apparatuses have been devised as is apparent from the following list of relevant patents and/or laid-open patent applications.

| Patent and/or application number | Inventor |
|---|---|
| Ca 5251,751 | Hogeberg |
| Ca 525,490 | Hogeberg |
| U.S. Pat. No. 5,415,409 | Hellmann |
| U.S. Pat. No. 5,411,267 | Burks et al. |
| U.S. Pat. No. 5,390,931 | Chiasson |
| U.S. Pat. No. 5,356,148 | Elder, Jr. |
| U.S. Pat. No. 5,351,964 | Kruger |
| U.S. Pat. No. 5,348,305 | Lowe |
| U.S. Pat. No. 5,330,194 | Copeland |
| U.S. Pat. No. 5,322,291 | Smith et al. |
| U.S. Pat. No. 5,282.629 | Eckstein |
| U.S. Pat. No. 5,131,661 | Jorgensen |
| U.S. Pat. No. 4,017,087 | Bruno |
| U.S. Pat. No. 3,738,663 | Gentiluomo |
| U.S. Pat. No. 3,294,402 | Scott |
| U.S. Pat. No. 2,696,985 | Hogeberg |
| U.S. Pat. No. 1,667,481 | Lange et al |
| WO 94/17865 | Beidas |
| WO 79/00112 | Atkinson |
| Fr 88 05852 | Labau |
| UK 2,274,788 | Beidas |
| UK 2,231,803 | Enscoe |
| AU 78,911/75 | Koji Izumi |
| JP 4-326216 | Toshihiro |
| JP 4-352618 | Seijun Oi |
| JP 4-331276 | Hideaki Toba |
| JP 4-203135 | Seijun Oi |
| JP 3-111079 | Shiyouzou K. |

Surprisingly, these apparatuses have been used so far in a very limited way only, for different reasons.

First of all, some of these apparatuses do not automatically tee up golf balls. The golfer has to activate the apparatus in some manner each time after hitting a golf ball to bring another ball, because the apparatus does not have a sensor to detect whether a golf ball is resting or not on the tee.

Some apparatuses use one or more photoelectric cells to detect the presence of the golf ball on the tee. However, after some time, these photoelectric cells get dirty and do not detect properly the presence of golf balls on the tee, especially when the apparatus is installed outdoor where dirt, sand or dust are carried by the wind.

Other apparatuses make use of air pressure sensitive detectors which do not work properly. A flow of air is injected in a hollow tee. If a golf ball rests on the tee, the ball traps the air inside the tee, thereby building up a pressure of air. The pressure is released when the ball is removed from the tee. Thus, the pressure detector detects the presence or the absence of a golf ball on the tee and activates or deactivates the apparatus. However, this kind of detector works only when there is a good seal between the golf ball and the tee. After a few hits, especially with iron, the tee tends to get damaged or cut, thereby reducing the tight seal. Thus, the apparatuses equipped with such a detector require the tee to be replaced very often.

Other known apparatuses cannot be used by both left-handed and right-handed golfers. These apparatuses are constructed in such a manner that a component of the apparatus, generally the hopper, prohibits the golfer to stand at a proper position to hit the golf ball in a particular direction or to take a normal swing with his club at the ball.

Last of all, some of the known apparatuses are powered by electricity on a regular voltage. If these apparatus are faulty, the golfer may get an electric shock. When the apparatus is used outside, on wet ground, that electric shock may even be deadly for the golfer.

OBJECT AND SUMMARY OF THE INVENTION

A first object of the present invention is to provide an apparatus for automatically teeing up golf balls, which is simple in structure, reliable, of low maintenance and without any rotating device that may wear off fast.

This first object is fully met with an apparatus for automatically teeing up golf balls, comprising a hopper, a teeing up device and a control means.

The hopper is intended for storing golf balls and supplying them to the teeing up device which is operatively connected thereto.

The teeing up device comprises a ball inlet, an upper horizontal tee off surface, a guide cylinder, a first block, a piston, a support, a second block, a detector means and a drive means.

The ball inlet receives golf balls from the hopper.

The upper tee off surface is provided with a hole sized to let one of the golf balls pass therethrough.

The guide cylinder is vertically mounted under the upper tee off surface. This guide cylinder has an open upper end in alignment with the hole of the upper tee off surface, a bottom part and a cylindrical wall having an inner diameter sized to receive and guide one of the golf balls. The cylindrical wall has a lateral upper opening sized to let one of the golf balls get into the cylinder.

The first block is adjacent to the guide cylinder. This first block has an upper inclined surface for holding and leading one of the golf balls into the lateral upper opening of the guide cylinder, and a side surface opposite to the guide cylinder and in front of the inlet at such a distance thereof as to leave room for one of the golf balls between the ball inlet and the side surface.

The piston is slidingly mounted inside the guide cylinder. This piston has a bottom part and is provided with an upwardly projecting flexible tee for holding one of the golf balls. The piston is movable between a lowermost position where one of the golf balls standing on the first block gets inside the guide cylinder via the lateral upper opening thereof and then rests over the tee, and an uppermost position where the tee juts out of the tee off surface through the hole provided therein. The piston has a lateral surface which extends in from the lateral upper opening and thus blocks access to the guide cylinder when the piston is in the uppermost position.

The support is fixed on the bottom part of the piston and moves in unison therewith between the lowermost position and the uppermost position.

The second block, slidably mounted between the ball inlet and the side of the first block, is fixed on the support and thus is solid with the piston. This second block has an upper inclined surface for receiving one of the golf balls supplied by the hopper to the ball inlet when the piston is in the lowermost position and lifting this golf ball up to the upper surface of the first block when the piston is in the uppermost position so that the golf ball rolls thereover thanks to the inclined upper surfaces of both the first and second blocks. The second block also has a side surface facing and blocking the ball inlet when the piston is in the uppermost position.

The detector means produces a ball detect signal when one of the golf balls rests over the tee.

The drive means moves the support between the lowermost and uppermost position in response to an electric signal.

The control means of the apparatus controls the operation of the drive means. The control means has an input for receiving the ball detect signal, and an output for producing the electrical signal to cause the drive means to move the piston in the uppermost position when the ball detect signal is produced and to move the piston in the lowermost position otherwise.

The apparatus according to the present invention can detect the presence of the golf ball on the tee. When no golf ball rests on the tee, the apparatus automatically tees up another golf ball. Accordingly, there is no need for the golfer to activate the apparatus after hitting each golf ball. Furthermore, by using this apparatus, the golfer no longer needs to move to tee up another golf ball and thus the golfer does not loose his feet position and alignment for his or her next swing.

It should be noted that every time a ball is teed up with the apparatus of the present invention, one, and only one, golf ball has already been isolated and is waiting to get into the guide cylinder, thereby preventing the apparatus to get jammed by too many golf balls at the lateral upper opening of the guide cylinder.

Furthermore, the apparatus according to the invention can be used by both left-handed and right-handed golfers, as no part comes in the way of the golfer, of his or her club or the ball.

Finally, the apparatus according to the invention is very simple in structure since it does not contain rotating parts which tend to wear off faster than others. Thus, the apparatus is very reliable and almost maintenance free.

A second object of the present invention is to provide a golf practicing kit allowing a golfer to practice precise golf shots in terms of distance and direction.

This second object of the invention is met by a kit for practicing golf. This kit comprises at least two targets, means for randomly choosing one of the targets and an apparatus for automatically teeing up golf balls.

With these advantages and innovations, the present invention fulfils a great need in the golf industry.

BRIEF DESCRIPTION OF THE DRAWINGS

The present invention will be more easily understood upon reading of the following non-restrictive description of a preferred embodiment thereof, made with reference to the accompanying drawings in which.

DESCRIPTION OF A PREFERRED EMBODIMENT OF THE INVENTION

For the purpose of simplicity, the same numeral references have been used throughout the description and drawings to identify the same structural elements.

Figure 1:
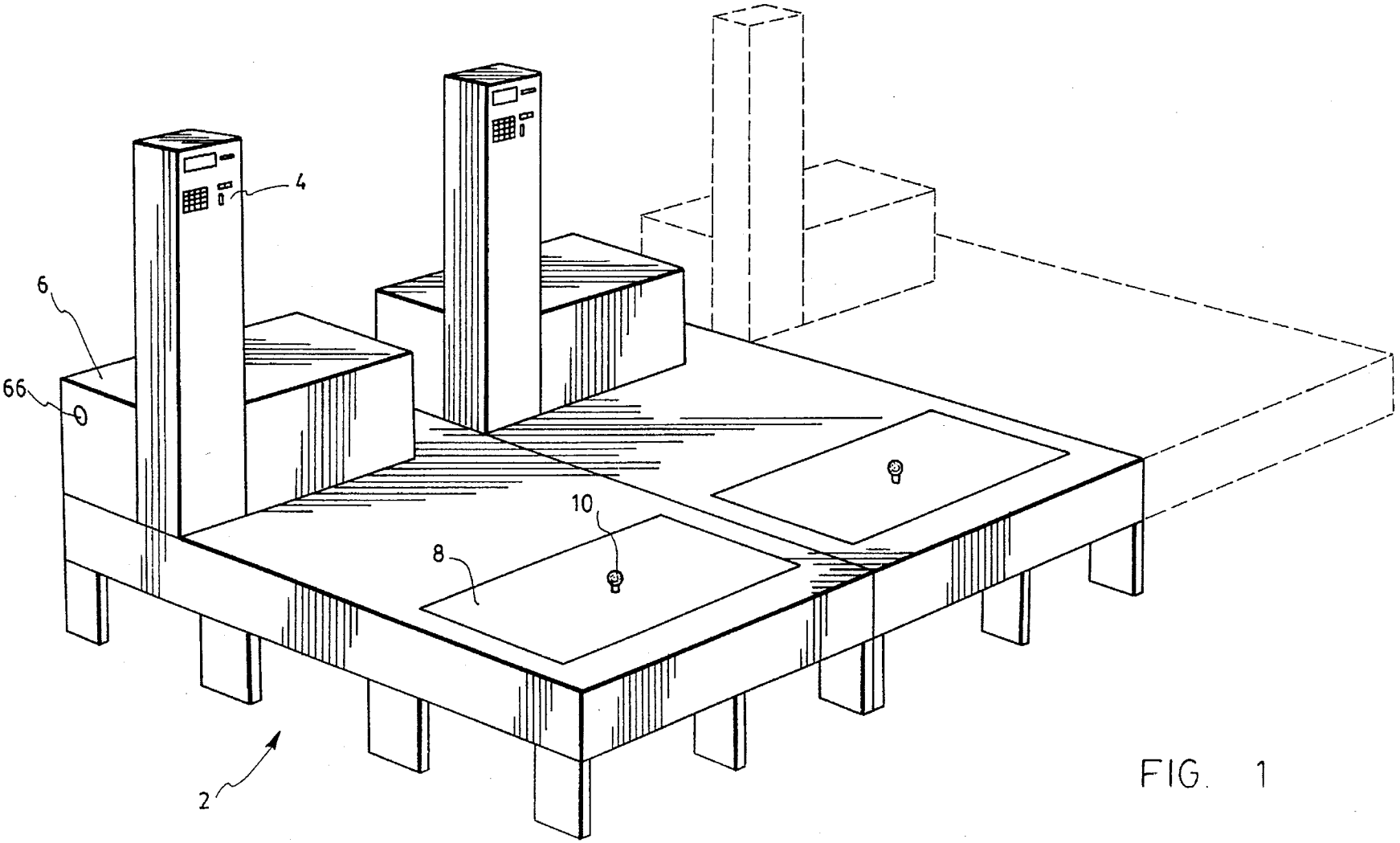
FIG. 1 is a perspective view of a driving range incorporating three golf ball teeing up apparatuses according to the invention.

FIG. 1 shows a driving range incorporating three apparatuses (2) according to the invention. As is shown, each apparatus (2) comprises a hopper (6), a control means (4) and a tee off surface (8) under which the teeing up device is located.

The hopper preferably has a capacity of containment of five thousand golf balls even though any other capacity could also be possible. A light indicator (66) may be provided on the hopper to indicate a low level of golf balls inside the same.

Figure 2:
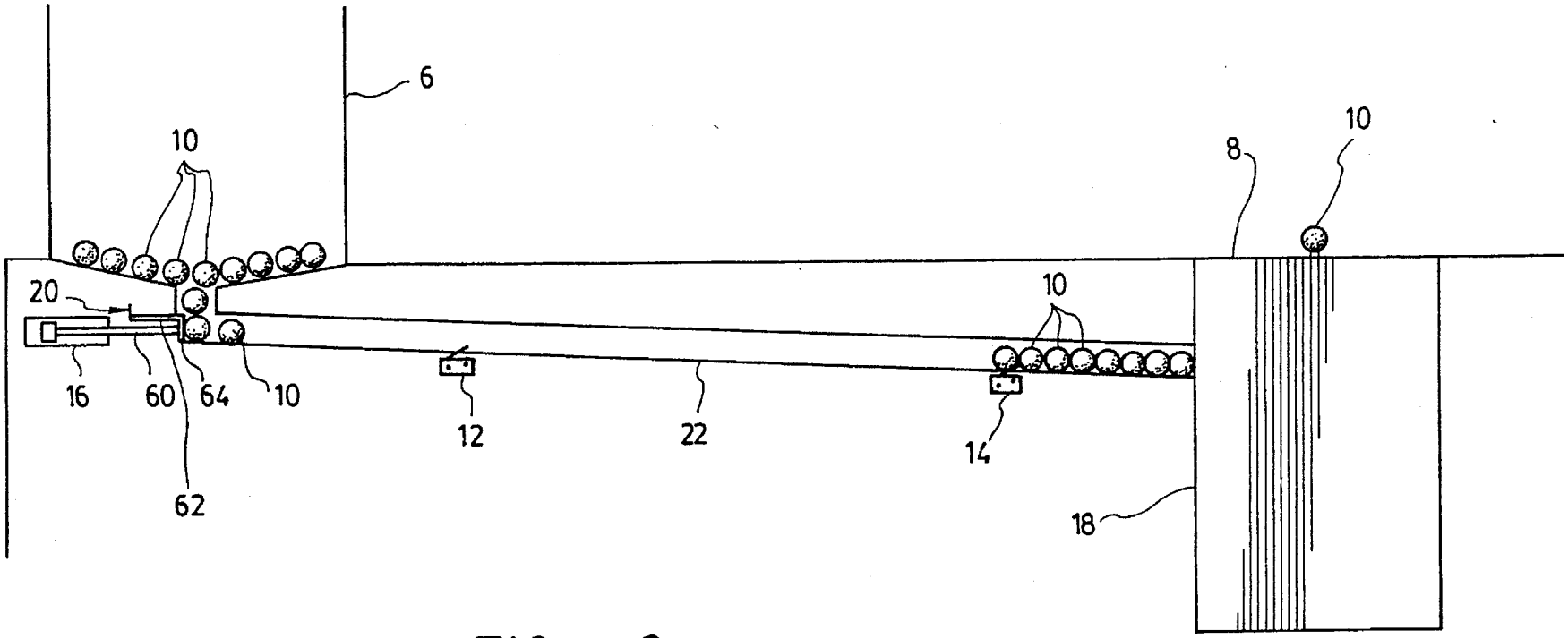
FIG. 2 is a schematic cross-sectional side view of one of the apparatuses according to the invention as shown in FIG. 1, showing the mechanism at the bottom of the hopper for feeding in golf balls to the teeing up device.
Figure 3:
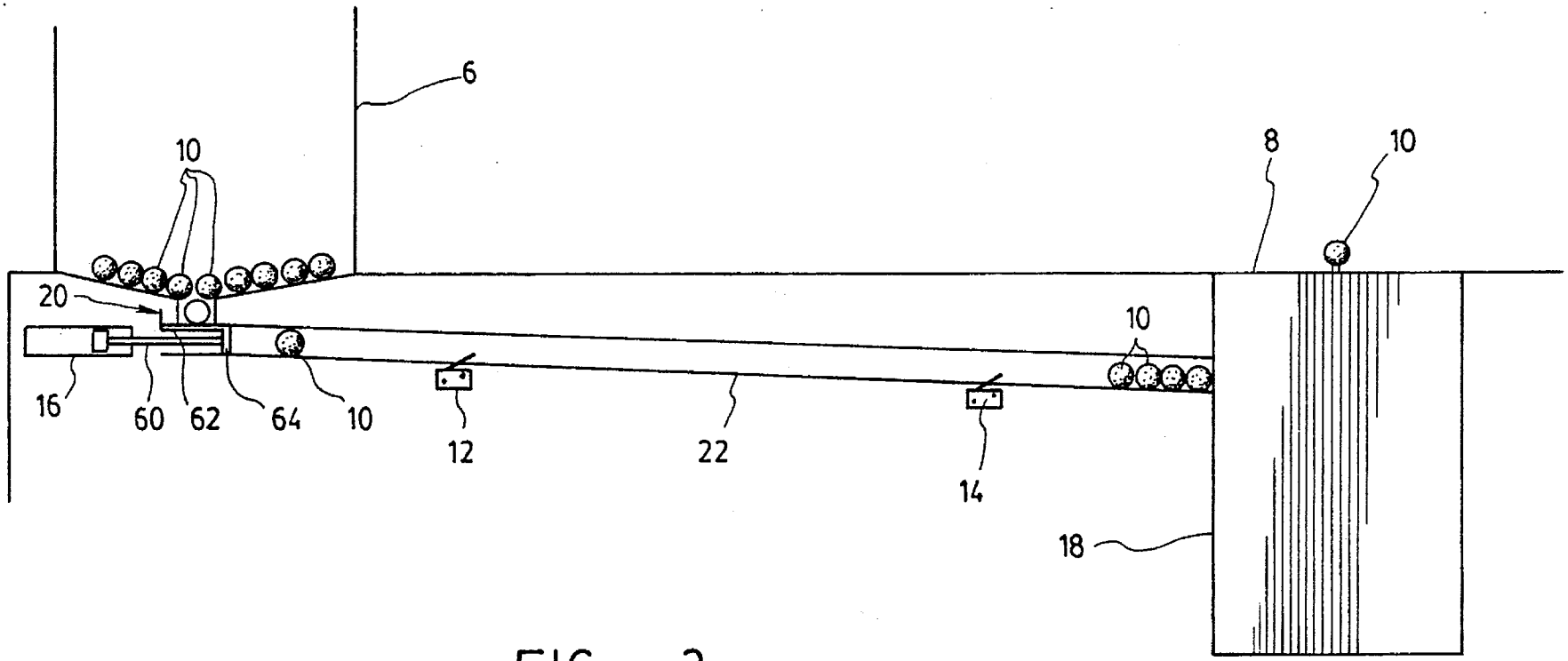
FIG. 3 is a view similar to the one of FIG. 2, showing the same mechanism in another position.

The golf balls get from the hopper (6) into the teeing up device (18) as is shown in FIGS. 2 and 3. In that preferred but non-limitative embodiment, such a connexion is achieved with a conduit (22) extending between the teeing up device (18) and the hopper (6). This conduit (22) has two ends. A double action piston (16) is installed at one end of that conduit (22), near the hopper (6). The double action piston (16) has a shaft (60). A L-shaped head (20) is fixed at the one end of the shaft (60) in such a manner that when the double action piston (16) is activated, the shaft (60) extends into the conduit (22). The L-shaped head (20) comprises a long arm (62) and a short arm (64). The long arm (62) of the L-shaped head (20) blocks the golf balls (10) from the hopper (6) to get into the conduit (22) while the short arm (64) of the L-shaped lead (20) pushes another golf ball (10) into the conduit (22) leading to the teeing up device (18). A first delayed switch (14) and a second delayed switch (12) are installed within the conduit (22) to detect the presence of the golf balls. The first delayed switch (14) is located close to the teeing up device (18). When the first delayed switch (14) does not detect any golf ball for a period of time longer than its time delay, it sends a signal to activate the double action piston (16) and thus send golf balls (10) in the conduit (22). The second delayed switch (12) is located between the double action piston (16) and the first delayed switch (14). When the second delayed switch (12) detects golf balls (10) for a period of time longer than its delay, this second switch (12) sends a signal to deactivate the double action piston (16), thereby stopping feeding in the golf balls (10) into the conduit (22).

Figure 4:
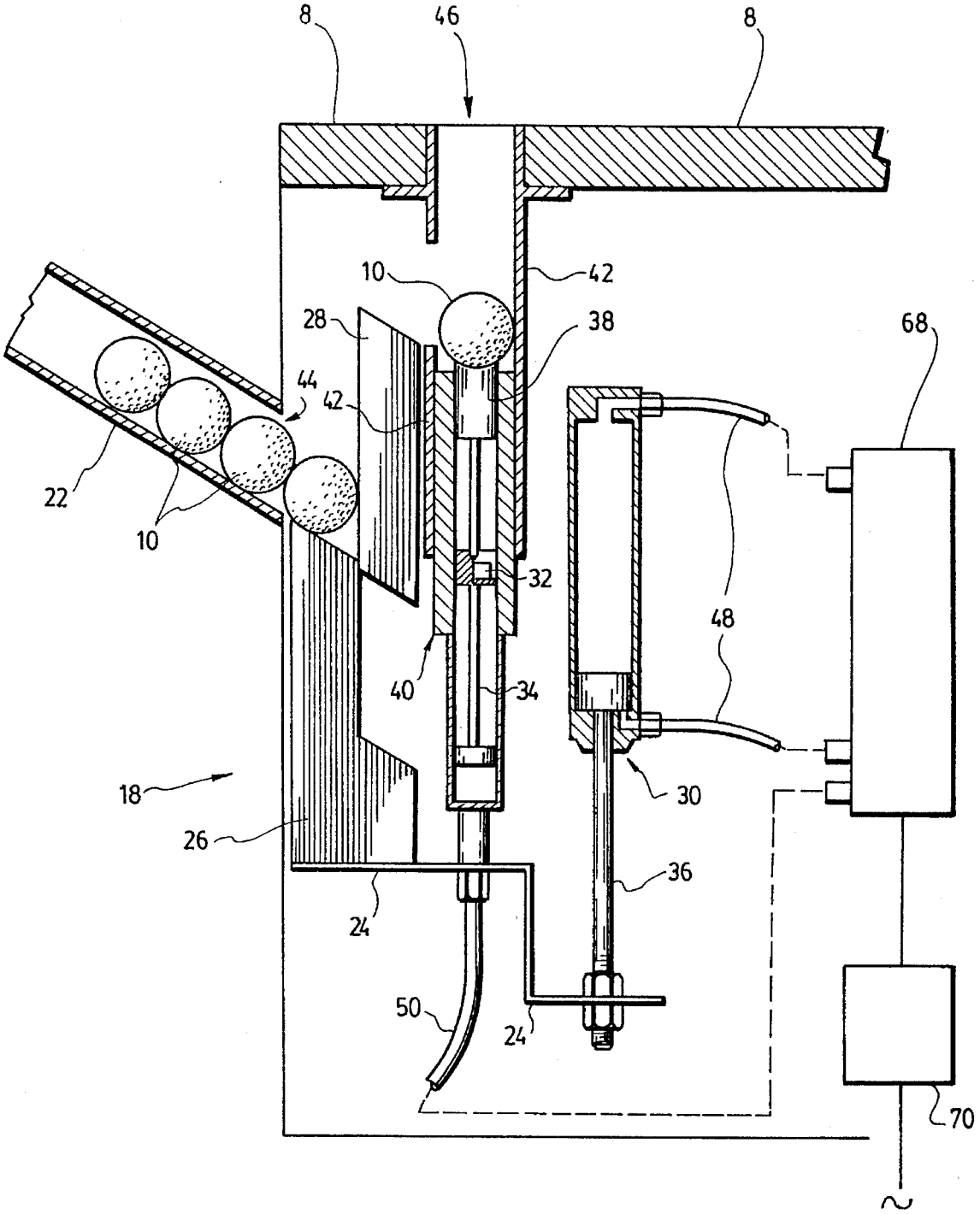
FIG. 4 is a schematic cross-sectional side view of the teeing up device of each apparatus shown in FIG. 1, wherein the piston is in its lowermost position for loading a golf ball.
Figure 5:
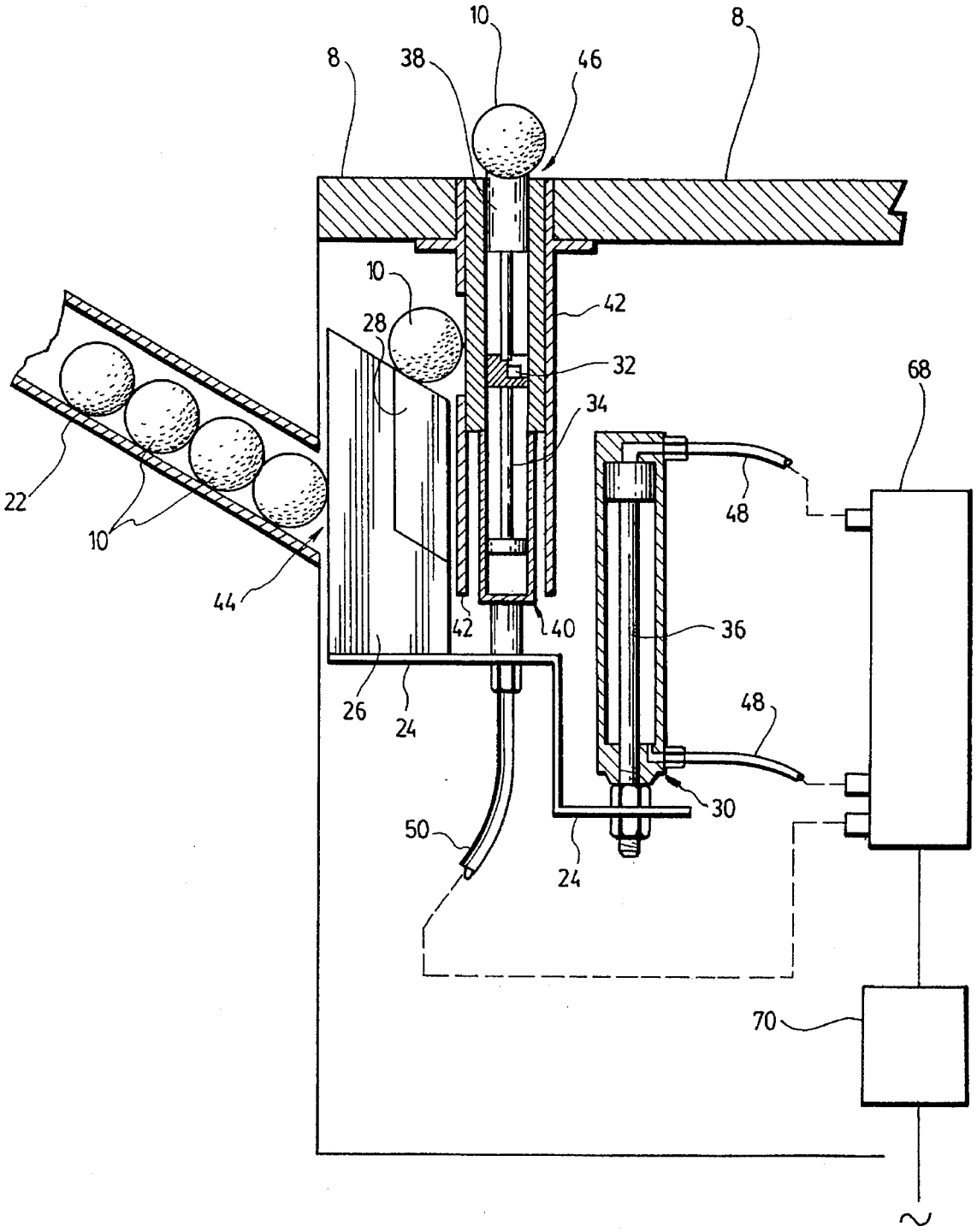
FIG. 5 is a view similar to the one of FIG. 4 showing the piston in the uppermost position for delivering the golf ball.

The teeing up device (18) as shown on FIGS. 4 and 5 comprises a ball inlet (44), an upper horizontal tee off surface (8), a guide cylinder (42), a first block (28), a piston (40), a support (24), a second block (26), a detector means (32), a drive means (30) and preferably a voltage reducer (70).

The ball inlet (44) receives the golf balls (10) coming from the hopper (6) through the conduit (22) to which it is operatively connected as is shown on FIGS. 2 and 3.

The upper horizontal tee off surface (8) shown on FIGS. 4 and 5 is provided with a hole (46) sized to let one of the golf balls (10) pass therethrough.

The guide cylinder (42) is vertically mounted under the upper tee off surface (8). The guide cylinder (42) has an open upper end in alignment with the hole (46) of the upper tee off surface (8), a bottom part and a cylindrical wall having an inner diameter sized to receive and guide one of the golf balls (10). The cylindrical wall has a lateral upper opening sized to let one of the golf balls (10) get into the cylinder (42).

The first block (28) is adjacent to the guide cylinder (42). This first block (28) has an upper inclined surface, preferably of 15°, for holding and leading one of the golf balls (10) into the lateral upper opening of the guide cylinder (42), and a side surface opposite to the guide cylinder and in front of the ball inlet (44) at such a distance thereof as to leave room for one of the golf balls (10) between the ball inlet (44) and the side surface.

The piston (40) is slidingly mounted inside the guide cylinder (42). It has a bottom part and is provided with an upwardly projecting tee (38) for holding one of the golf balls (10). This piston (40) is movable between a lowermost position as shown on FIG. 4 where one of the golf balls (10) standing on the first block (28) gets inside the guide cylinder (42) via the lateral upper opening thereof and then rests over the tee (38), and an uppermost position as shown on FIG. 5 where the tee (38) juts out of the upper tee off surface (8) through the hole (46) provided therein. The piston (40) also has a lateral surface which extends in front of the lateral upper opening and thus blocks access to the guide cylinder (42) when the piston (40) is in the uppermost position. The tee (38) can be made of very soft rubber screwed in place by a threaded central core preferably made of graphite.

The support (24) is fixed to the bottom part of the piston (40) and moves in unison therewith between the lowermost and the uppermost position.

The second block (26) is slidably mounted between the ball inlet (44) and the side of the first block (28). This second block (26) is fixed on the support (24) and thus is solid with the piston (40). This second block (26) also has an upper inclined surface, preferably of 15°, for receiving one of the golf balls (10) supplied by the conduit (22) to the ball inlet (44) when the piston (40) is in the lowermost position and lifting this golf ball (10) to the upper surface of the first block (26) when the piston is in the uppermost position so that the golf ball rolls thereover thanks to the inclined upper surfaces of both the first and second blocks (28, 26). The second block (26) has a side surface facing and blocking the ball inlet (44) when the piston (40) is in the uppermost position.

Figure 6:
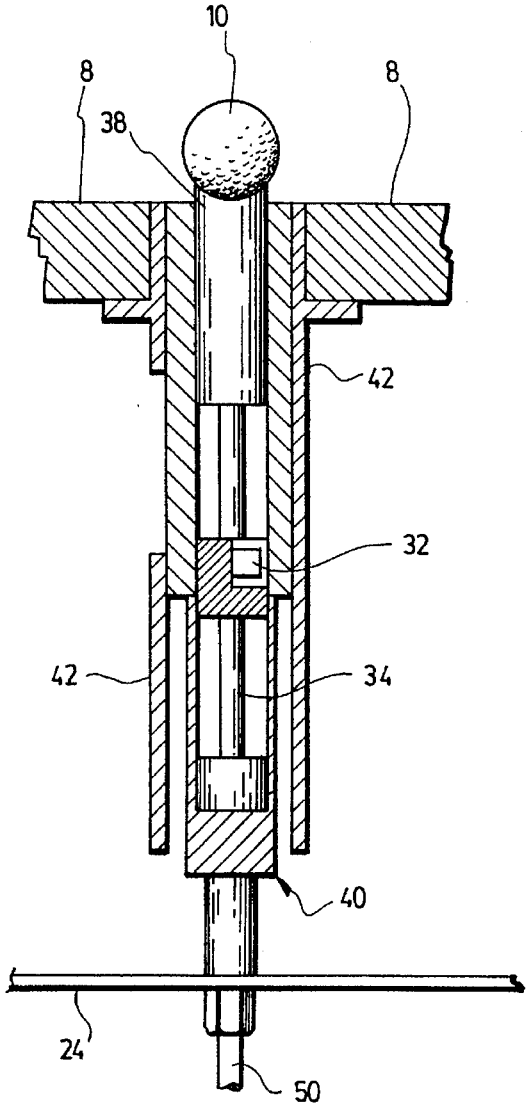
FIG. 6 is an enlarged view of the tee adjustment means of the teeing up device of FIG. 5, in a fairway lie position.
Figure 7:
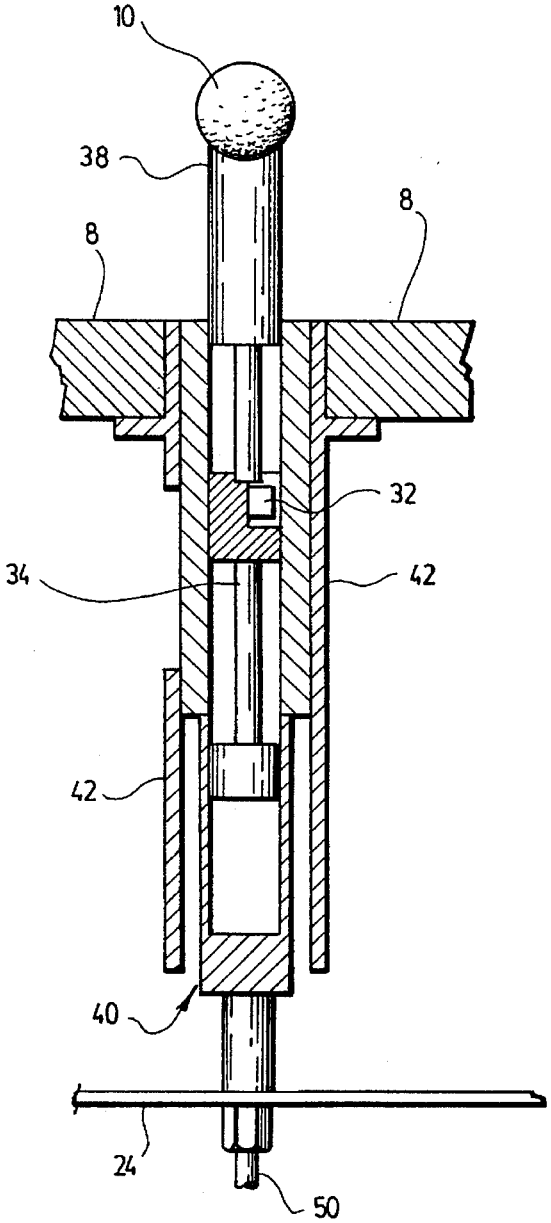
FIG. 7 is a view similar to the one of FIG. 6 showing the tee adjustment means in a tee off lie position.

The detector means (32) located under the tee (38) within the guide cylinder (42) is preferably a mechanical switch as illustrated in FIGS. 6 and 7. This detector means (32) is activated by a combined weight of the tee (38) and one of the golf balls (10) and produces a ball detect signal when one of the golf balls (10) rests over the tee (38).

The drive means (30), as is shown in FIGS. 4 and 5, moves the support (24) and thus moves the piston (40) between the lowermost and the uppermost position. The drive means (30) comprises a driving piston (36) and a source of compressed gas or air. This gas or air is preferably supplied by a compressor (68). Of course, the driving piston (36) could also be hydraulic. The driving piston (36) is preferably a double action piston and is connected via two tubes (48) to the source of compressed gas or air to move the piston (36) between the lowermost (see FIG. 4) and uppermost (see FIG. 5) position in response to an electric signal.

As is shown in FIGS. 4 and 5, a voltage reducer (70) is preferably used. This voltage reducer (70) is plugged to a regular source of electricity and reduces the voltage preferably to 24 volts. Accordingly, the electricity used by the apparatus to produce all the electric signals is supplied by the voltage reducer (70).

Preferably, the teeing up device (18) comprises a tee adjustment means. As is shown in FIGS. 4 to 7, this tee adjustment means is preferably a piston (34). This piston (34) is located under the tee (38) within the bottom of the piston (40) of the teeing up device (18) for adjusting the height of the tee (38). The piston (34) is preferably a double action piston and is connected via a tube (50) to the compressor (68) supplying compressed gas or air for moving the tee (38) between a tee off lie position and a fairway lie position when the piston (40) is in the uppermost position. It is worth noting that the piston (34) could also be hydraulic.

Figure 8:
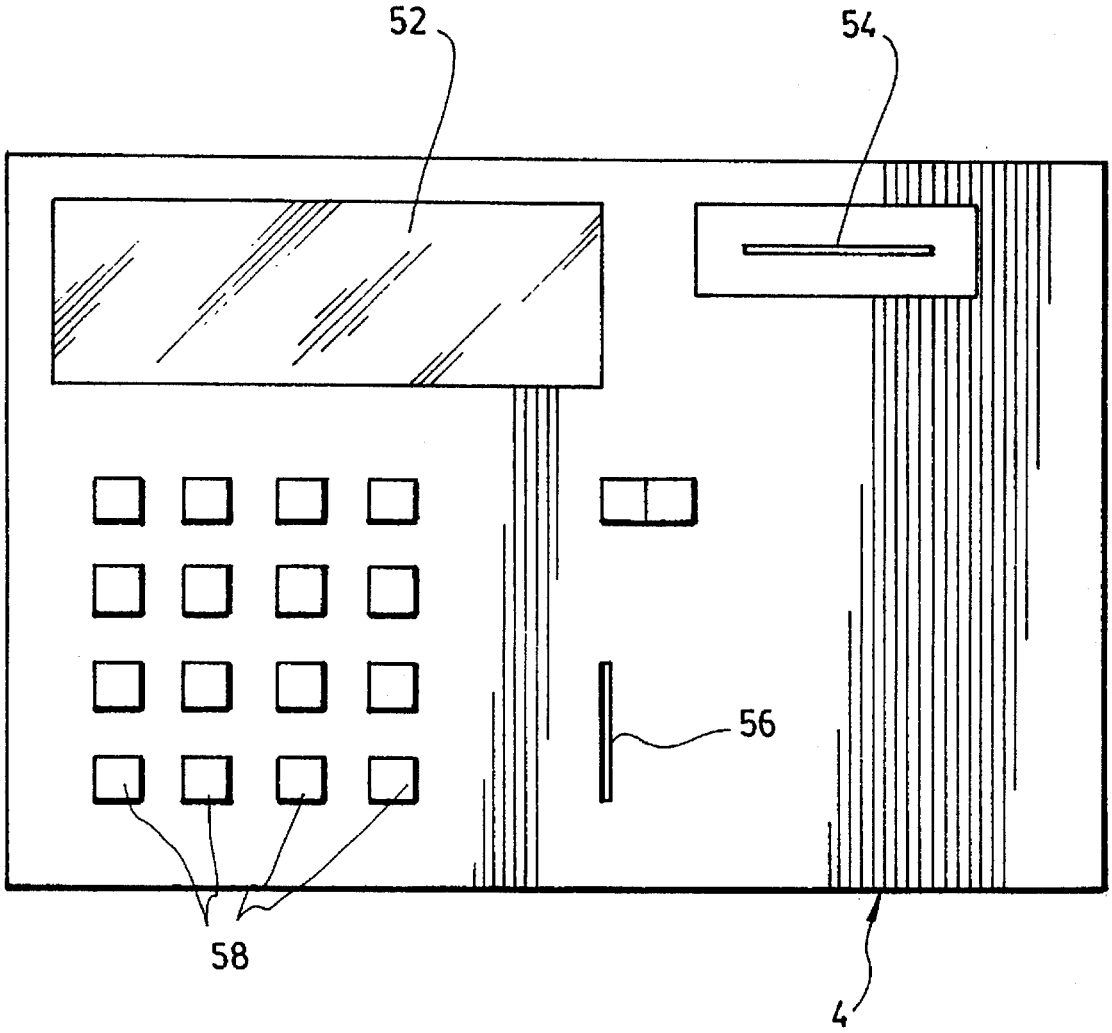
FIG. 8 is an enlarged front view of the control panel of each apparatus shown on FIG. 1.

The control means (4) of FIGS. 1 and 8 is preferably a control panel. This control means (4) is provided with a display window (52), a card slot (54), a coin slot (56) and operation keys (58). The control means (4) can be adapted to receive as payment either coins, paper money, credit cards, debit cards or any other magnetic card such as prepaid magnetic member card. Upon receipt of payment, the control means (4) activates the apparatus. From this control means (4), the position of the tee can be controlled as needed and the number of balls or time left to play can be indicated.

The compressed gas or air supply can be supplied in the tubes (48, 50) by the compressor (68) preferably remotely located for easier access to. Accordingly the pressure of gas or air can be adjusted to control the speed at which the golf balls are teed up on the tee.

The apparatus according to the present invention as disclosed hereinabove is light, easy of assembly and easy to move. Its teeing up device is compact as the movement of the drive means is limited. Also, the tee can be change easily.

Every apparatus according to the invention has a hopper. However, a single hopper of a bigger capacity could also be used for feeding several apparatuses together. The tee up surface of the apparatus can also be covered with a synthetic grass carpet.

Figure 9:
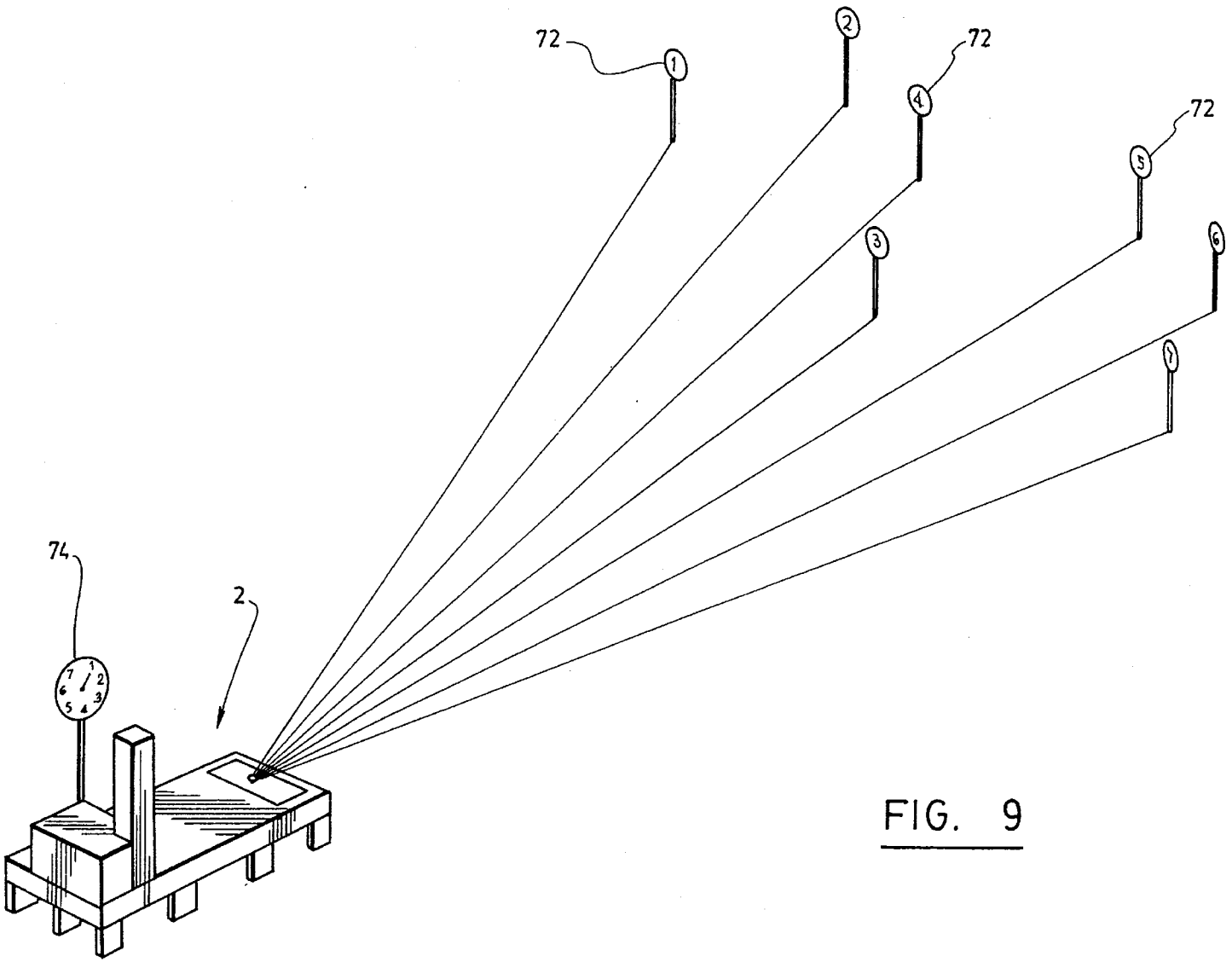
FIG. 9 is a perspective view a driving range incorporating the kit according to the invention to practice golf.

The kit for practicing golf as is shown in FIG. 9 comprises targets (72), possibly as the ones already available commercially. The targets (72) are posted in a driving range at different distances from a tee off. The kit for practicing golf also comprises means for randomly choosing one of the targets (72) and an apparatus (2) for automatically teeing up golf balls. The means for randomly choosing one of the targets is preferably a device (74) comprising a pointing arrow spun around choices of targets written on a board or an electronic random decision maker as those already existing.

Of course, the above description of the invention could be extended to any variation that any person in the art would or could think of. As an example, the apparatus could comprise a ball counter, a cycle counter or a timer to count either the number of balls or the time that have been paid for on the control means.

The embodiments of the invention in which an exclusive property or privilege is claimed are defined as follows:

1. An apparatus for automatically teeing up golf balls comprising:

a hopper for storing golf balls, said hopper having a bottom part;

a teeing up device operatively connected to the bottom part of the hopper, said device comprising:

a ball inlet for receiving golf balls from the hopper;

an upper horizontal tee off surface provided with a hole sized to let one of the golf balls pass therethrough;

a guide cylinder vertically mounted under the upper tee off surface, said cylinder having an open upper end in alignment with the hole of the upper tee off surface, a bottom part and a cylindrical wall having an inner diameter sized to receive and guide one of said golf balls, said wall having a lateral upper opening sized to let one of the golf balls get into the cylinder;

a first block adjacent to the guide cylinder, the block having an upper inclined surface for holding and leading one of the golf balls into the lateral upper opening of the guide cylinder, and a side surface opposite to the guide cylinder and in front of the inlet at such a distance thereof as to leave room for one of said golf balls between the ball inlet and the side surface;

a piston slidingly mounted inside the guide cylinder, the piston having a bottom part and being provided with an upwardly projecting flexible tee for holding one of the golf balls, the piston being movable between a lowermost position where one of the golf balls standing on the first block gets inside the guide cylinder via the lateral upper opening thereof and then rests over the tee, and an uppermost position where the tee juts out of the tee off surface through the hole provided therein, the piston having a lateral surface which extends in front of the lateral upper opening and thus blocks access to the guide cylinder when the piston is in the uppermost position;

a support fixed on the bottom part of the piston and moves in unison therewith between the lowermost position and the uppermost position;

a second block slidably mounted between the ball inlet and the side of the first block, the second block being fixed on the support and thus being solid with the piston, the second block having an upper, inclined surface for receiving one of the golf balls supplied by the hopper to the ball inlet when the piston is in the lowermost position and lifting this golf ball up to the upper surface of the first block when the piston is in the uppermost position so that the golf ball rolls thereover thanks to the inclined upper surfaces of both the first and second blocks, the second block having a side surface facing and blocking the ball inlet when the piston is in the uppermost position;

detector means for producing a ball detect signal when one of the golf balls rests over the tee; and drive means for moving the support between the lowermost and uppermost position in response to an electric signal; and control means for controlling operation of the drive means, the control means having an input for receiving the ball detect signal, and an output for producing the electrical signal to cause the drive means to move the piston in the uppermost position when the ball detect signal is produced and to move the piston in the lowermost position otherwise.

2. An apparatus according to claim 1 further comprising a tee adjustment means fixed under the tee to the bottom part of the piston for moving the tee between a tee off lie position and a fairway lie position when the piston is in the uppermost position.

3. An apparatus according to claim 2, wherein the tee adjustment means is a double action piston moving between the tee off lie position and the fairway position by the action of compressed gas supplied by a compressor.

4. An apparatus according to claim 3, wherein the compressed gas is air.

5. An apparatus according to claim 1, wherein the detector means of the teeing up device is a mechanical switch located under the tee within the bottom part of the guide cylinder, the switch being activated by a combined weight of the tee and one of the golf balls.

6. An apparatus according to claim 1, wherein the drive means of the teeing up device is a double action piston solid with the support, the double action piston moving the support between the lowermost and the uppermost position under action of compressed gas supplied by a compressor.

7. An apparatus according to claim 6, wherein the compressed gas is air.

8. An apparatus according to claim 1, wherein the control means is adapted to receive at least one form of payment to cause activation of said apparatus.

9. An apparatus according to claim 8, wherein the at least one form of payment is selected from the group consisting of coins, paper money, credit cards and debit cards.

10. An apparatus according to claim 1, further comprising a ball counter.

11. An apparatus according to claim 1, wherein the hopper comprises a double action piston mounted generally horizontal in the bottom part therein to force out one of the golf balls at a time.

12. An apparatus according to claim 11, further comprising a conduit having a first and a second opening, said conduit having an inner diameter sized to receive and guide one of the golf balls, the first opening being operatively connected to the lower part of the hopper and the second opening being connected to the ball inlet of the teeing up device, the conduit comprising a first and a second ball supplying detector means, the first detector means being located nearest to the ball inlet and activating the piston of the hopper when not detecting one of said golf balls and the second detector means located nearest to the lower part of the hopper and deactivating the piston of said lower part of the hopper when detecting one of said golf balls.

13. An apparatus according to claim 12, wherein the first and second detector means are mechanical switches.

14. An apparatus according to claim 1, wherein the control means further comprises a voltage reducer to operate said apparatus under reduced voltage.

15. An apparatus according to claim 1, wherein the upper inclined surface of the first and second block has an inclination of 15°.

16. An apparatus according to claim 4, wherein:

the detector means of the teeing up device is a mechanical switch located under the tee within the bottom part of the guide cylinder, the switch being activated by a combined weight of the tee and one of the golf balls;

the drive means of the teeing up device is a double action piston solid with the support, the double action piston moving the support between the lowermost and the uppermost position under action of compressed air supplied by a compressor;

the control means is adapted to receive at least one form of payment selected from the group constituted of: coins, paper money, credit card and debit card, to cause the activation of the apparatus;

the hopper comprises a double action piston mounted generally horizontal in the bottom part therein to force out one of the golf balls at a time;

said apparatus further comprises a ball counter and a conduit, said conduit having a first and a second opening and an inner diameter sized to receive and guide one of the golf balls, said first opening being operatively connected to the lower part of the hopper and said second opening being connected to the ball inlet of the teeing up device, the conduit comprising a first and a second ball supplying mechanical switch, said first switch being located nearest to the ball inlet and activating the piston of the hopper when not detecting one of said golf balls and said second switch being located nearest to the lower part of the hopper and deactivating the piston of said lower part of the hopper when detecting one of said golf balls;

the control means further comprises a voltage reducer to operate said apparatus under reduced voltage; and the upper inclined surface of the first and second block has an inclination of 15°.

17. A kit for practising golf comprising:

at least two targets, said targets being posted in a driving range at different distance from a tee off;

means for randomly choosing one of said targets; and an apparatus for automatically teeing up golf balls on said tee off, said apparatus comprising:

a hopper for storing golf balls, said hopper having a bottom part;

a teeing up device operatively connected to the bottom part of the hopper, said device comprising:

a ball inlet for receiving golf balls from the hopper;

an upper horizontal tee off surface provided with a hole sized to let one of the golf balls pass therethrough;

a guide cylinder vertically mounted under the upper tee off surface, said cylinder having an open upper end in alignment with the hole of the upper tee off surface, a bottom part and a cylindrical wall having an inner diameter sized to receive and guide one of said golf balls, said wall having a lateral upper opening sized to let one of the golf balls get into the cylinder;

a first block adjacent to the guide cylinder, the block having an upper inclined surface for holding and leading one of the golf balls into the lateral upper opening of the guide cylinder, and a side surface opposite to the guide cylinder and in front of the inlet at such a distance thereof as to leave room for one of said golf balls between the ball inlet and the side surface;

a piston slidingly mounted inside the guide cylinder, the piston having a bottom part and being provided with an upwardly projecting flexible tee for holding one of the golf balls, the piston being movable between a lowermost position where one of the golf balls standing on the first block gets inside the guide cylinder via the lateral upper opening thereof and then rests over the tee, and an uppermost position where the tee juts out of the tee off surface through the hole provided therein, the piston having a lateral surface which extends in front of the lateral upper opening and thus blocks access to the guide cylinder when the piston is in the uppermost position;

a support fixed on the bottom part of the piston and moves in unison therewith between the lowermost position and the uppermost position;

a second block slidably mounted between the ball inlet and the side of the first block the second block being fixed on the support and thus being solid with the piston, the second block having an upper inclined surface for receiving one of the golf balls supplied by the hopper to the ball inlet when the piston is in the lowermost position and lifting this golf ball up to the upper surface of the first block when the piston is in the uppermost position so that the golf ball rolls thereover thanks to the inclined upper surfaces of both the first and second blocks, the second block having a side surface facing and blocking the ball inlet when the piston is in the uppermost position;

detector means for producing a ball detect signal when one of the golf balls rests over the tee; and drive means for moving the support between the lowermost and uppermost position in response to an electric signal; and control means for controlling operation of the drive means, the control mans having an input for receiving the ball detect signal, and an output for producing the electrical signal to cause the drive means to move the piston in the uppermost position when the ball detect signal is produced and to move the piston in the lowermost position otherwise.

18. A kit according to claim 17, wherein the means for choosing one of the targets is a pointing device spun around a wheel on which choices of targets are written.

* * * * *